US009889968B2

(12) United States Patent
Morewitz et al.

(10) Patent No.: US 9,889,968 B2
(45) Date of Patent: Feb. 13, 2018

(54) CUP AND LID USING MAGNETIC-BASED SPILL-PROOF SEAL

(71) Applicants: Cory L Morewitz, Newport News, VA (US); Herbert Morewitz, II, Newport News, VA (US)

(72) Inventors: Cory L Morewitz, Newport News, VA (US); Herbert Morewitz, II, Newport News, VA (US)

( * ) Notice: Subject to any disclaimer, the term of this patent is extended or adjusted under 35 U.S.C. 154(b) by 0 days.

(21) Appl. No.: 15/139,429

(22) Filed: Apr. 27, 2016

(65) Prior Publication Data

US 2016/0318669 A1 Nov. 3, 2016

Related U.S. Application Data

(60) Provisional application No. 62/154,979, filed on Apr. 30, 2015.

(51) Int. Cl.

| | |
|---|---|
| ***B65D 51/00*** | (2006.01) |
| ***B65D 25/20*** | (2006.01) |
| ***B65D 43/02*** | (2006.01) |
| ***B65D 47/28*** | (2006.01) |
| *A47G 19/22* | (2006.01) |
| *B65D 81/38* | (2006.01) |

(52) U.S. Cl.

CPC ..... *B65D 25/20* (2013.01); *A47G 19/2272* (2013.01); *B65D 43/0222* (2013.01); *B65D 47/286* (2013.01); *A47G 19/2288* (2013.01); *B65D 81/3865* (2013.01); *B65D 2543/00046* (2013.01); *B65D 2543/00527* (2013.01); *B65D 2543/00537* (2013.01)

(58) Field of Classification Search

CPC ..... B65D 51/18; B65D 2543/00046; B65D 43/26

USPC ..... 220/253, 254.9, 259.5, 212, 202, 254.1, 220/262, 260, 315, 351, 711, 713, 714, 220/345.1, 345.4, 230, 345.2; 222/514, 222/166, 522, 525

See application file for complete search history.

(56) References Cited

U.S. PATENT DOCUMENTS

| | | | | |
|---|---|---|---|---|
| 2006/0124526 | A1* | 6/2006 | Flick | C02F 1/481 210/222 |
| 2007/0039980 | A1* | 2/2007 | Kjeldsen | B67D 7/005 222/514 |
| 2017/0121072 | A1* | 5/2017 | Seiders | B65D 51/18 |

(Continued)

*Primary Examiner* — J. Gregory Pickett
*Assistant Examiner* — Allan Stevens
(74) *Attorney, Agent, or Firm* — Peter J. Van Bergen

(57) ABSTRACT

A cup/lid combination includes a sleeve disposed about an exterior surface of an open-top container for movement relative to the container. A first magnet is disposed adjacent to the open top for movement relative to the container. A link assembly coupled to the sleeve and to the first magnet causes the movement of the sleeve and the movement of the first magnet to be in opposing directions. A drinking lid disposed on the open top has a gravity-controlled closure element and a second magnet coupled to the closure element. The first and second magnets are positioned for magnetic interaction to thereby fix a position of the closure element when the sleeve is only subject to the force of gravity. The first and second magnets are positioned for no magnetic interaction when the movement of the sleeve opposes the force of gravity.

19 Claims, 4 Drawing Sheets

(56) References Cited

U.S. PATENT DOCUMENTS

| | | | | |
|---|---|---|---|---|
| 2017/0121073 | A1* | 5/2017 | Seiders | B65D 51/18 |
| 2017/0121074 | A1* | 5/2017 | Seiders | B65D 51/18 |

* cited by examiner

CUP AND LID USING MAGNETIC-BASED SPILL-PROOF SEAL

Pursuant to 35 U.S.C. §119, the benefit of priority from provisional application 62/154,979, with a filing date of Apr. 30, 2015, is claimed for this non-provisional application.

FIELD OF THE INVENTION

The invention relates generally to travel cups and mugs, and more particularly to a cup and lid that use magnetic force to provide a spill-proof seal.

BACKGROUND OF THE INVENTION

Travel cups or mugs filled with hot or cold liquids go from home to car, and then on to the office, gym, etc., and vice versa, every day. Regardless of their design, the lid of a travel mug has an opening through which a user drinks. When not being held, these mugs are set down on counters, dashboards, consoles, desks, etc. In general, the surfaces on which a travel cup/mug sits are areas of high activity and/or can be sloped or uneven. As a result, travel cups/mugs are often knocked over. When this occurs, liquid in the cup/mug flows through the lid's drink opening to create a spill.

SUMMARY OF THE INVENTION

Accordingly, it is an object of the present invention to provide a cup/mug that will not spill its contents when knocked over.

Another object of the present invention is to provide a cup/mug having a drink opening that remains closed when the cup/mug is upright and when it is knocked over, but opens automatically when one tips the cup/mug to drink therefrom.

Other objects and advantages of the present invention will become more obvious hereinafter in the specification and drawings.

In accordance with the present invention, a cup and lid combination includes a liquid-holding container having an open top. A sleeve is disposed about an exterior surface of the container for movement relative to the container. A first magnet is disposed adjacent to the open top of the container for movement relative to the container. A link assembly is coupled to the sleeve and to the first magnet for causing the movement of the sleeve and the movement of the first magnet to be in opposing directions. A drinking lid is disposed on the open top of the container. The drinking lid has a gravity-controlled closure element and a second magnet coupled to the closure element. The first magnet and second magnet are positioned for magnetic interaction to thereby fix a position of the closure element when the sleeve is only subject to the force of gravity. The first magnet and second magnet are positioned for no magnetic interaction when the movement of the sleeve opposes the force of gravity.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
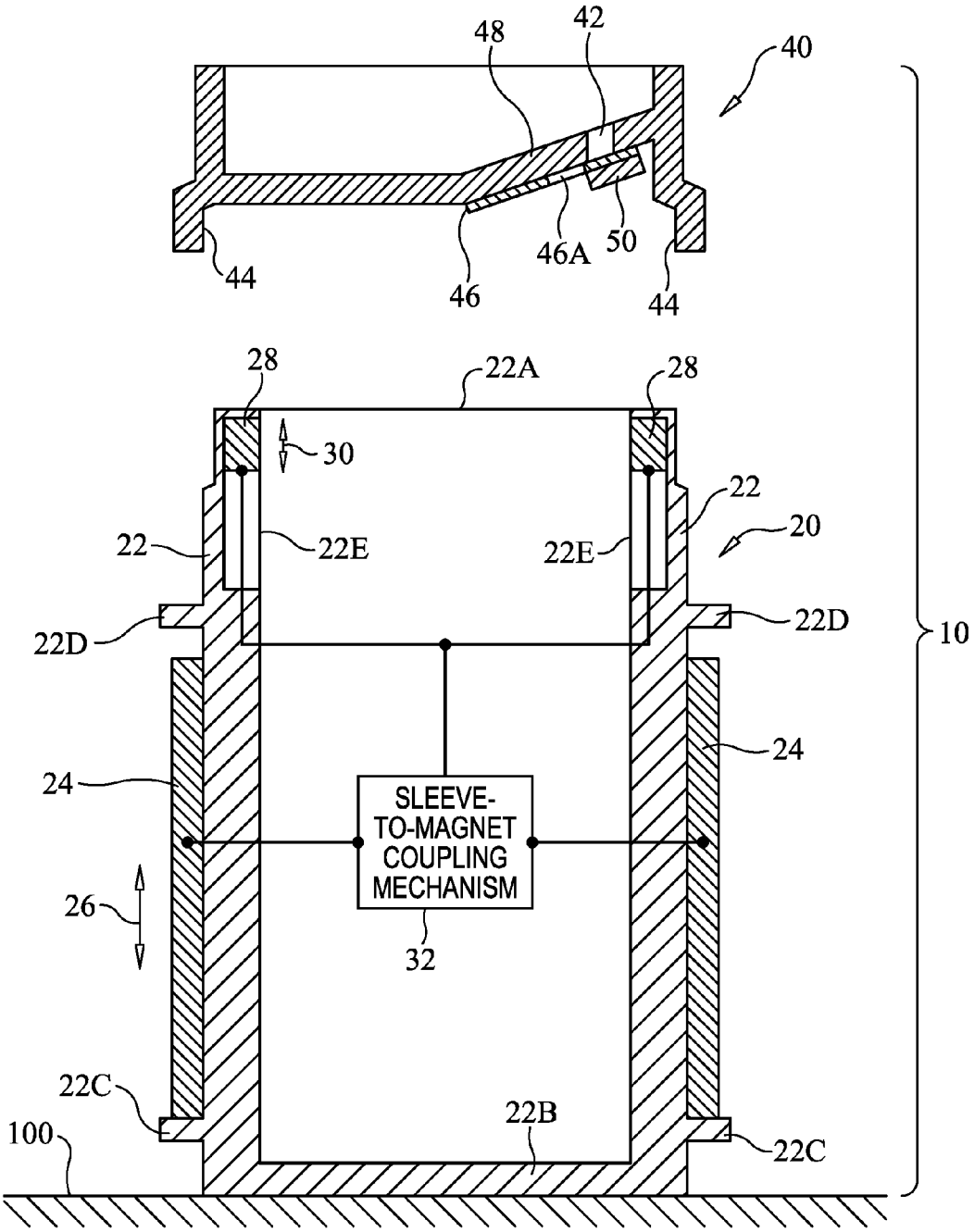
FIG. 1 is an exploded cross-sectional view of a cup and lid combination using a magnetic-based spill-proof seal system in accordance with an embodiment of the present invention.

Referring now to the drawings and more particularly to FIG. 1, the combination of a cup 20 and lid 40 using a magnetic-based spill-proof seal system in accordance with an embodiment of the present invention is shown and is referenced generally by numeral 10. Combination 10 is shown in an exploded view to clearly delineate the features associated with each of cup 20 and lid 40. The way that these features cooperate to form a spill-proof seal system when lid 40 is coupled to cup 20 will be illustrated and explained later herein. Coupling of lid 40 to the top of cup 20 can be accomplished in a variety of ways without departing from the scope of the present invention.

Cup 20 includes a liquid-holding container 22 that can be made from a variety of materials without departing from the scope of the present invention. For example, container 22 can be fabricated using materials that provide thermal insulation for a liquid placed therein. Container 22 can also be a variety of shapes and sizes. Container 22 has an open top 22A and a closed bottom 22B. Disposed about a portion of the exterior surface of container 22 is an annular sleeve 24 that is also coupled to container 22 in a way that allows a fixed amount of axial travel 26 of sleeve 24 along container 22 as indicated by a two-headed arrow. End points of axial travel 26 can be defined by, for example, a lower stop 22C and an upper stop 22D provided on (or integral with) the exterior surface of container 22. In addition or alternatively, a portion of the inside surface of sleeve 24 could be configured for an indexed relationship with a portion of the outside surface of container 22 (e.g., using tongue-and-groove principles). In terms of a tongue-and-groove indexing scheme, the axial or longitudinal ends of the groove (defined in either in container 22 or sleeve 24) define the stops for axial travel 26 of sleeve 24 that will engage a tongue (that is formed on either container 22 or sleeve 24).

In general, sleeve 24 is disposed over a portion of container 22 that is typically gripped by a user when picking up container 22. When cup 20 rests on a surface 100 as shown, sleeve 24 is only acted upon by the force of gravity such that sleeve 24 abuts travel stop 22C and is at its point of axial travel 26 that is closest to closed bottom 22B. When a user grips sleeve 24 and lifts upward, sleeve 24 travels axially up along container 22 against the force of gravity until sleeve 24 reaches its upward end point of axial travel 26 (e.g., at travel stop 22D) that is closest to open top 22A at which point cup 20 is raised off surface 100.

Mounted on or in container 22 near open top 22A are one or more magnet(s) 28. For example, magnet(s) 28 can be positioned for sliding axial movement relative to container 22 within a sleeve(s) 22E defined in the walls of container 22 as shown. By way of an illustrative example, magnet 28 can be a single annular magnetic (i.e., a ring) near open top 22A. In general, container 22 supports magnet(s) 28 in a way that provides for a fixed amount of axial travel 30 thereof along container 22 as indicated by a two-headed arrow 30. Axial travel 30 of magnet 28 is controlled by the axial travel 26 of sleeve 24. In general, axial travel 26 of sleeve 24 towards open top 22A causes axial travel 30 of magnet 28 towards closed bottom 22B. Conversely, axial travel 26 of sleeve 24 towards closed bottom 22B causes axial travel 30 of magnet 28 towards open top 22A. Accordingly, when cup 20 is resting on surface 10, sleeve 24 is acted on only by the force of gravity thereby causing sleeve 24 to be at its point along axial travel 26 that is closest to closed bottom 22B and causing magnet 28 to be at its point along axial travel 30 that is closest to open top 22A.

A sleeve-to-magnet coupling mechanism 32 is provided on or within the side walls of container 22 for the purpose of coupling sleeve 24 to magnet 28. Coupling mechanism 32 converts the direction of the sleeve's axial travel 26 into an opposing direction of the magnet's axial travel 30. That is, when sleeve 24 moves up and away from closed bottom 22B, magnet 28 moves down and away from open top 22A. Conversely, when sleeve 24 moves down towards closed bottom 22B, magnet 28 moves up towards open top 22A.

Figure 2A:
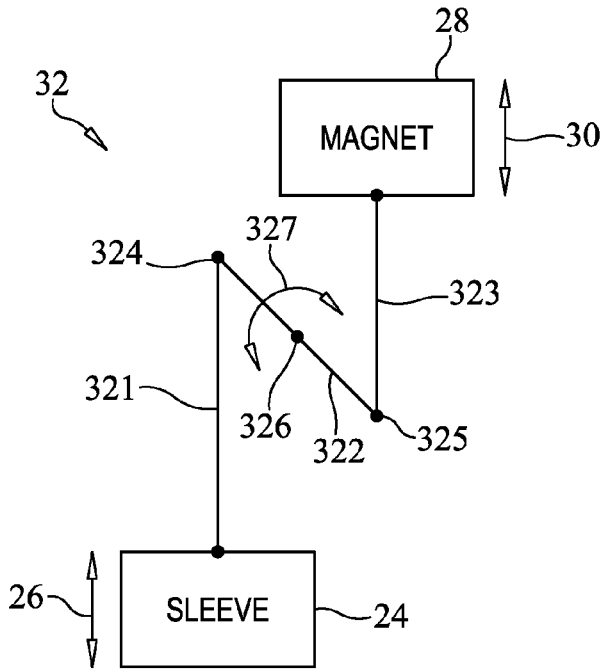
FIG. 2A is an isolated schematic view of a sleeve-to-magnet coupling mechanism in accordance with an embodiment of the present invention.

A variety of constructions for coupling mechanism 32 could be used to support the above-described opposing axial movements without departing from the scope of the present invention. By way of example, three mechanical coupling mechanisms that support the above-described opposing directions of axial travel 26 and axial travel 30 are illustrated schematically in FIGS. 2A-2C. In FIG. 2A, coupling mechanism 32 includes three rods 321, 322 and 323 that are linked together via pivot joints or hinges 324 and 325. More specifically, rod 321 is coupled to sleeve 24 and hingedly coupled to rod 322 at hinge 324; rod 323 is coupled to magnet 28 and hingedly coupled to rod 322 at hinge 325; and rod 322 is supported via a pivot joint or mount 326 that supports pivot movement as indicated by two-headed arrow 327.

Figure 2B:
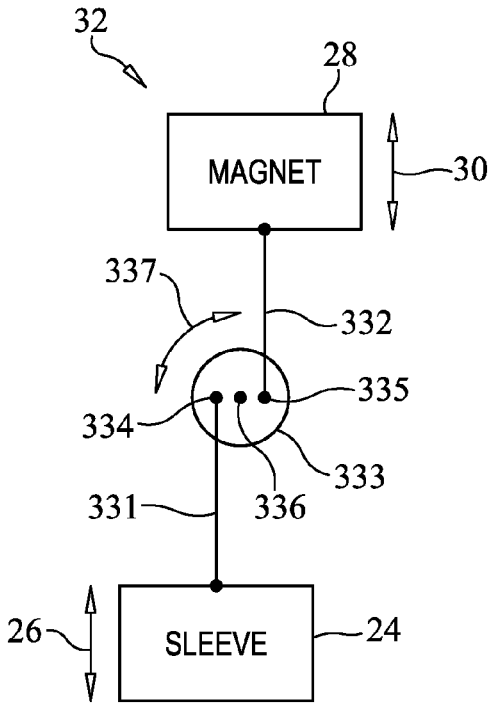
FIG. 2B is an isolated schematic view of a sleeve-to-magnet coupling mechanism in accordance with another embodiment of the present invention.

In FIG. 2B, coupling mechanism 32 includes two rods 331 and 332, and a rotatable joint 333. More specifically, rod 331 is coupled to sleeve 24 and pivotally coupled to joint 333 at a pivot 334; rod 332 is coupled to magnet 28 and pivotally coupled to joint 333 at a pivot 335; and rotatable joint 333 is supported via a pivot mount 336 that supports pivot movement as indicated by two-headed arrow 337.

Figure 2C:
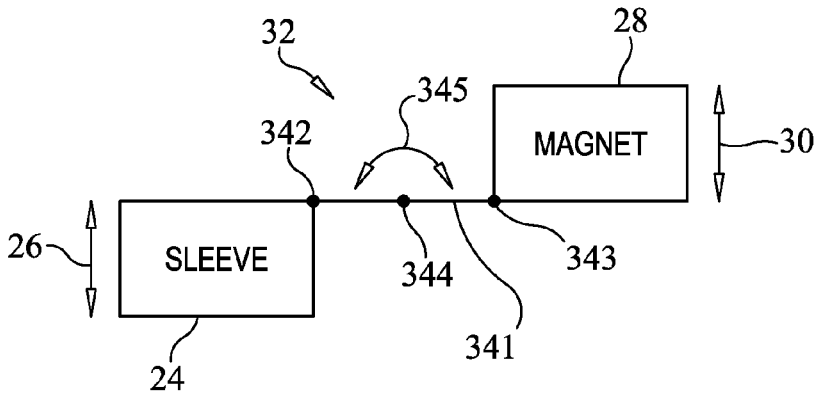
FIG. 2C is an isolated schematic view of a sleeve-to-magnet coupling mechanism in accordance with still another embodiment of the present invention.

In FIG. 2C, coupling mechanism 32 includes a single rod 341 that is pivotally coupled on one end thereof to sleeve 24 at a joint/pivot 342, and pivotally coupled on the other end thereof to magnet 28 at a joint/pivot 343. Rod 341 is supported via a pivot mount 344 that supports pivot movement as indicated by two-headed arrow 345.

Referring again to FIG. 1, lid 40 is the type of lid designed to sip, drink, or pour through. In terms of the present invention, lid 40 has a drink hole 42 that is automatically opened/closed based on the orientation of the lid in accordance with the teachings of U.S. Pat. No. 8,678,220, the contents of which are hereby incorporated by reference. Lid 40 also includes an annular cup interface region 44 that allows lid 40 to be placed on and sealed to open top 22A. Interface region 44 can define threads, snap-on features, push-to-seal features, etc., that support the coupling of lid 40 to cup 20. The configuration of interface region 44 and the mating portion of open top 22A are not limitations of the present invention.

The automatic open/close feature of lid 40 disclosed by U.S. Pat. No. 8,678,220 is provided by a slidable closure element 46 that is slidably coupled to a canted or sloped region 48 of lid 40. Briefly, this patent discloses a closure element 46 having a hole 46A that is not aligned with drink hole 42 when lid 40 is in its upright position (as shown). However, when lid 40 is tipped to a drinking orientation, closure element 46 automatically slides along sloped region 48 until drink hole 42 and hole 46A are aligned with one another. Briefly, the automatic sliding movement of closure element 46 when lid 40 is tipped is controlled by the force of gravity acting on a weight integrated with or coupled to closure element 46. In accordance with an embodiment of the present invention, the weight coupled to closure element 46 is a magnet 50 that experiences magnetic repulsion from magnet 28 when combination 10 is upright on surface 100 or when combination 10 (i.e., lid 40 coupled to cup 20) has been knocked over. As will be explained further below, the magnetic repulsion force seals closure element 46 over hole 42 and prevents sliding movement of closure element 46 even when combination 10 is knocked over. However, when combination 10 is lifted by a user gripping sleeve 24, the magnetic repulsion force is eliminated as upward axial travel 26 of sleeve 24 causes downward axial travel 30 of magnet 28 thereby allowing the weight of magnet 50 to control sliding movement of closure element 46 based on the orientation of lid 40 as described in the above-referenced U.S. Pat. No. 8,678,220.

Figure 3:
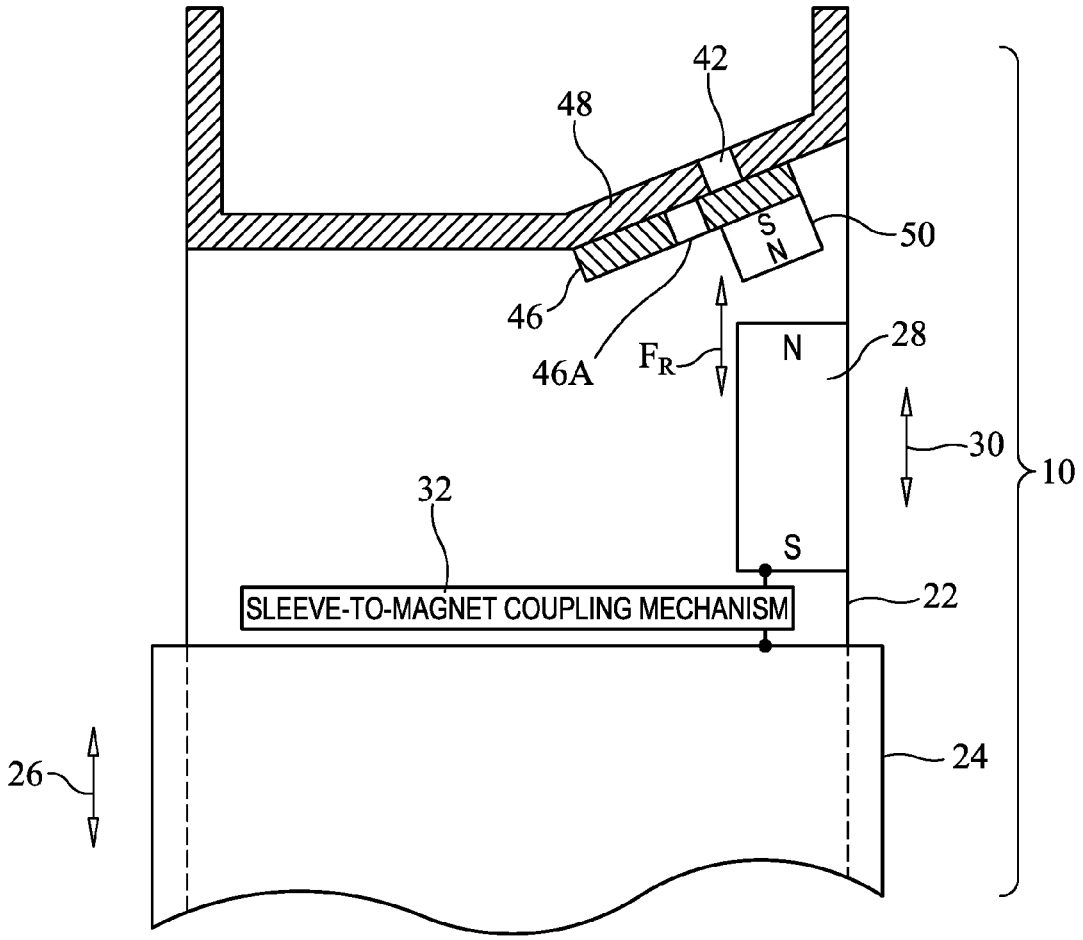
FIG. 3 is a part schematic and part cross-sectional view of a portion of a cup and its lid illustrating the lid's closure element held in a sealing relationship with the lid's drink hole using magnetic repulsion in accordance with an embodiment of the present invention.
Figure 4:
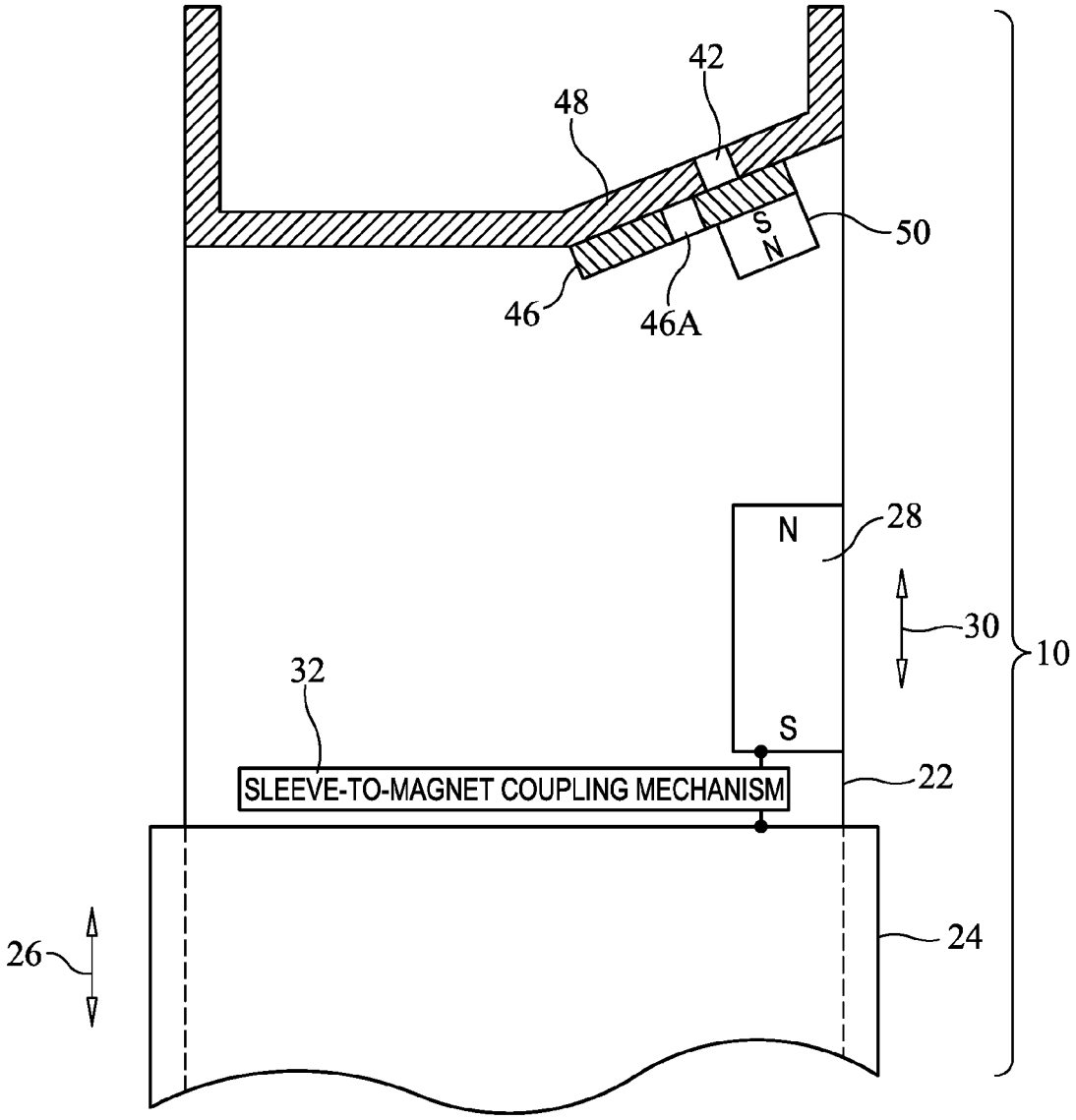
FIG. 4 is a part schematic and part cross-sectional view of a portion of a cup and its lid illustrating the lid's closure element and the cup's magnet when the cup's magnet has been moved to a position that permits drinking from the cup.

The sealing and spill-proof features of the present invention provided by a magnetic repulsion force are illustrated in FIG. 3, whereas the elimination of the magnetic repulsion force is illustrated in FIG. 4. The north ("N") and south ("S") polarities on each of magnet 28 and magnet 50 are shown. It is to be understood that a north-to-north or south-to-south magnetic repulsion could be used without departing from the scope of the present invention. For clarity of illustration, magnets 28 and 50 are shown as single blocks. However, it is to be understood that magnets 28/50 could be shaped other than as shown without departing from the scope of the present invention. For example, magnets 28/50 could be shaped for male-female engagement (e.g., one magnet end is convex and the other magnet end is correspondingly concave) at the same time the repulsion force is in effect to thereby also form a mechanical link between closure element 46 (via magnet 50) and magnet 28. Also, for clarity of illustration, only the exterior wall of container 22 is shown in FIGS. 3 and 4.

In FIG. 3, it is assumed that sleeve 24 is not being gripped/lifted by a user such that sleeve 24 is being acted only by the force of gravity whereby sleeve 24 abuts lower stop 22C and is at its lowest point of axial travel 26 causing magnet 28 to be at its highest point of axial travel 30. As a result, the north poles of magnets 28 and 50 are in close enough proximity that a magnetic repulsion force $F_R$ pushes closure element 46 up towards sloped region 48. More specifically, repulsion force $F_R$ pushes closure element 46 against sloped region 48 to thereby keep holes 42 and 46A in misalignment to effectively seal drink hole 42 when combination 10 is upright (as shown). In addition, if combination 10 is knocked over, sleeve 24 will not move axially by an appreciable amount so that magnetic repulsion force $F_R$ will still operate to seal closure element 46 against sloped region 48 with hole 46A remaining misaligned with respect to hole 42. The sealing effect can be enhanced during a "knock over" if magnets 28/50 are shaped for male-female engagement as explained above.

Referring now to FIG. 4, sleeve 24 is assumed to have been gripped by a user and lifted up to overcome the force of gravity such that sleeve 24 attains its highest point of axial travel 26. As a result, magnet 28 is moved down and away from magnet 50 such that the above-described magnetic repulsion force is eliminated. When this occurs, magnet 50 functions only as a weight thereby allowing lid 40 to operate as described in the above-referenced U.S. Pat. No. 8,678,220. That is, when magnet 50 is functioning solely as a weight, closure element 46 is subject only to the force of gravity and is, therefore, free to automatically control the automatic opening/closing of lid 40 based on the orientation of lid 40 when the user is gripping sleeve 24 and raises combination 10. At this point, any tipped orientation of lid 40 is purposefully controlled by the user to facilitate drinking or pouring.

The advantages of the present invention are numerous. A cup/lid's drinking hole is only exposed when a user purposefully lifts the cup/lid and purposefully tips same to take a drink or pour out the liquid. At all other times to include when the cup/lid is knocked over, the lid's closure element is sealed to the lid's drink hole.

Although the invention has been described relative to specific embodiments thereof, there are numerous variations and modifications that will be readily apparent to those skilled in the art in light of the above teachings. For example, the magnets could be arranged such that a magnetic attraction force is used to seal the drink hole when the cup/lid are upright on a surface or when the cup/lid has been knocked over. In this type of embodiment, upward movement of the container's sleeve would remove the magnetic attraction force to thereby allow the lid's closure element to function as described above. It is therefore to be understood that, within the scope of the appended claims, the invention may be practiced other than as specifically described.

What is claimed as new and desired to be secured by Letters Patent of the United States is:

1. A cup and lid combination, comprising:

a liquid-holding container having an open top and a closed bottom;

a sleeve disposed about an exterior surface of said container for movement relative to said container;

a first magnet disposed adjacent to said open top of said container for movement relative to said container;

a link assembly coupled to said sleeve and to said first magnet for causing said movement of said sleeve and said movement of said first magnet to be in opposing directions; and a drinking lid disposed on said open top of said container, said drinking lid having a first hole and having a gravity-controlled closure element, said closure element having a second hole and a second magnet coupled to said closure element, said first magnet and said second magnet being positioned for magnetic interaction to thereby fix a first position of said closure element when said sleeve is closest to said closed bottom wherein said first hole and said second hole are misaligned, and said first magnet being repositioned when said sleeve is closest to said open top wherein movement of said closure element to a second position is predicated on an orientation of said drinking lid and wherein said first hole and said second hole are aligned in said second position.

2. The cup and lid combination as in claim 1, wherein said container comprises a thermally insulating container.

3. The cup and lid combination as in claim 1, wherein said first magnet comprises a ring-shaped magnet.

4. The cup and lid combination as in claim 1, further comprising stops coupled to said container and positioned to define a fixed amount of said movement of said sleeve.

5. The cup and lid combination as in claim 1, wherein said link assembly comprises:

at least one rod; and at least one movable joint coupled to said at least one rod.

6. The cup and lid combination as in claim 1, wherein said first magnet is disposed within a wall of said container.

7. The cup and lid combination as in claim 1, wherein said magnetic interaction comprises magnetic repulsion.

8. A cup and lid combination, comprising:

a liquid-holding container having an open top and a closed bottom;

a sleeve disposed about an exterior surface of said container for axial movement relative to said container;

a first magnet disposed adjacent to said open top of said container for axial movement relative to said container;

a link assembly coupled to said sleeve and to said first magnet for causing said axial movement of said sleeve and said axial movement of said first magnet to be in opposing directions; and a drinking lid disposed on said open top of said container, said drinking lid having a first hole and having a gravity-controlled closure element, said closure element having a second hole and a second magnet coupled to said closure element, wherein said first magnet and said second magnet are positioned for magnetic interaction to thereby fix a first position of said closure element when said sleeve is closest to said closed bottom wherein said first hole and said second hole are misaligned, and wherein said first magnet is repositioned when said sleeve is closest to said open top wherein movement of said closure element to a second position is predicated on an orientation of said drinking lid wherein said first hole and said second hole are aligned in said second position.

9. The cup and lid combination as in claim 8, wherein said container comprises a thermally insulating container.

10. The cup and lid combination as in claim 8, wherein said first magnet comprises a ring-shaped magnet.

11. The cup and lid combination as in claim 8, further comprising stops coupled to said container and positioned to define a fixed amount of said axial movement of said sleeve.

12. The cup and lid combination as in claim 8, wherein said link assembly comprises:

at least one rod; and at least one movable joint coupled to said at least one rod.

13. The cup and lid combination as in claim 8, wherein said first magnet is disposed within a wall of said container.

14. The cup and lid combination as in claim 8, wherein said magnetic interaction comprises magnetic repulsion.

15. A cup and lid combination, comprising:

a liquid-holding container having an open top and a closed bottom;

a sleeve disposed about an exterior surface of said container for movement relative to said container;

a first magnet disposed within a wall of said container and adjacent to said open top of said container for movement relative to said container;

a link assembly coupled to said sleeve and to said first magnet for causing said movement of said sleeve and said movement of said first magnet to be in opposing directions; and a drinking lid disposed on said open top of said container, said drinking lid having a first hole and having a gravity-controlled closure element, said closure element having a second hole and a second magnet coupled to said closure element, said first magnet and said second magnet being positioned for magnetic repulsion to thereby fix a first position of said closure element when said sleeve is closest to said closed bottom wherein said first hole and said second hole are misaligned, and said first magnet being repositioned when said sleeve is closest to said open top wherein movement of said closure element to a second position is predicated on an orientation of said drinking lid and wherein said first hole and said second hole are aligned in said second position.

16. The cup and lid combination as in claim 15, wherein said container comprises a thermally insulating container.

17. The cup and lid combination as in claim 15, wherein said first magnet comprises a ring-shaped magnet.

18. The cup and lid combination as in claim 15, further comprising stops coupled to said container and positioned to define a fixed amount of said movement of said sleeve.

19. The cup and lid combination as in claim 15, wherein said link assembly comprises:

at least one rod; and at least one movable joint coupled to said at least one rod.

* * * * *